United States Patent [19]

Krehbiel

[11] 4,005,464

[45] Jan. 25, 1977

[54] APPARATUS AND METHOD FOR PROCESSING PHOTOGRAPHIC FILM

[75] Inventor: Vivian D. Krehbiel, Wichita, Kans.

[73] Assignee: Kreonite, Inc., Wichita, Kans.

[22] Filed: Oct. 20, 1975

[21] Appl. No.: 623,729

[52] U.S. Cl. ..... 354/322

[51] Int. Cl.[2] ..... G03D 3/12

[58] Field of Search ..... 354/345, 346, 322, 297, 354/307, 312, 319, 320, 321, 331

[56] References Cited

UNITED STATES PATENTS

| | | | |
|---|---|---|---|
| 1,325,748 | 12/1919 | Marette | 354/321 |
| 1,825,310 | 9/1931 | Engstrom | 354/345 |
| 1,865,682 | 7/1932 | Dye | 354/322 |
| 2,458,394 | 1/1949 | Luboshez | 354/321 |
| 3,192,845 | 7/1965 | Schmidt | 354/321 |
| 3,712,206 | 1/1973 | Schmidt | 354/322 |
| 3,780,637 | 12/1973 | Horn | 354/321 |

FOREIGN PATENTS OR APPLICATIONS

| | | | |
|---|---|---|---|
| 889,384 | 2/1962 | United Kingdom | 354/320 |

*Primary Examiner*—Donald A. Griffin
*Attorney, Agent, or Firm*—John H. Widdowson; Edwin H. Crabtree

[57] ABSTRACT

An apparatus and method for developing both black and white and color photographic film using a spirally wound tube. Each convolution of the tube is adapted to contain a selected film treating fluid agent.

The film to be photographically processed is attached to a carrier having a magnetic element mounted thereon. The carrier with the trailing film is inserted into the spirally wound tube. A conveyor belt having magnets attached thereto is disposed adjacent the inner circumference of the outer surface of the convolutions of the tube. The film is processed by the carrier being magnetically guided by the magnet on the conveyor belt through the sequence of the different film treating fluid agents in the convolutions of the tube.

28 Claims, 17 Drawing Figures

APPARATUS AND METHOD FOR PROCESSING PHOTOGRAPHIC FILM

BACKGROUND OF THE INVENTION

This invention relates generally to film processing and more particularly, but not by way of limitation, to a film processing apparatus using magnetic attraction to guide the film through a spirally wound tube containing film treating fluid agents.

Heretofore in the developing of black and white and color photographic film, the film is processed in a dark room wherein the film is passed from one treating solution to another. The treating solutions are contained in large individual tanks. When this process is completed the film is washed and dryed. Each step of this type of film developing is done by hand therefore the process is time consuming. Because the equipment may require adjustment and changes done in the dark room this also requires additional time. Also the open top tanks allow the sensitive treating agents to be exposed to excessive oxidation thereby causing added expense to the process.

Recently the novel use of a photographic film developing apparatus was introduced using a spirally wound tube wherein each convolution contained a selected film treating fluid agent. A carriage having a magnetic element mounted thereon is used to traverse the spiral tube pulling the film behind. The carriage is guided through the tube using a vertically reciprocating bar magnetic which is magnetically responsive to the magnetic element on the carriage. The subject invention as herein described is similar in some aspects to this photographic film developing apparatus.

SUMMARY OF THE INVENTION

The subject apparatus for processing photographic film minimizes the waste and oxidation of the sensitive film treating fluid agents. This invention also eliminates the hazard of developing film in a dark room. The film processing apparatus is adaptable for both black and white or color film having various lengths and widths. The apparatus is easy to clean and maintain and operates efficiently in greatly reducing the time required to process film. The subject invention also eliminates processing film by hand and the inadvertent treating of film with the wrong film treating agent or the mixing together of different film treating agents.

The apparatus includes a spirally wound tube. The tube can be turned in various directions or reverse itself to take advantage of minimum space requirements. The convolutions of the tube can contain a sequence of the same film treating film agents or different film treating fluid agents depending on the type of process used. The convolutions of the tube can be made of various lengths depending on the time required for the film to be submerged in a particular film treating film agent in the convolution. The film is attached at one end to a carrier having a magnetic element carried thereon. The carrier with the trailing film is inserted into one end of the tube. The carrier is guided through the sequence of the convolutions by the magnetic attraction between the carrier's magnetic element and a magnet attached to a conveyor belt disposed adjacent the inner circumference of the outer surface of the tube.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
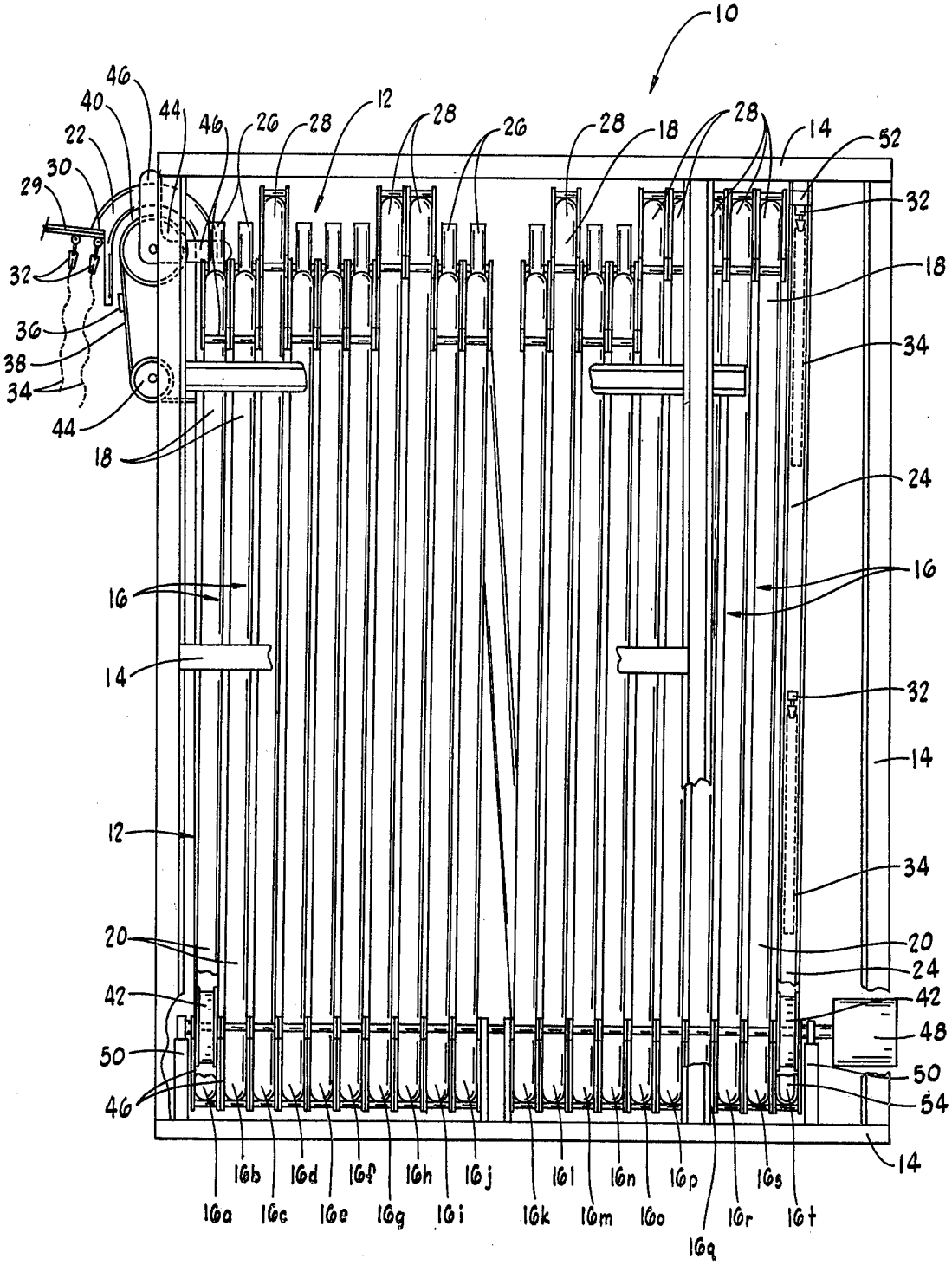
FIG. 1 is a side view of the photographic film processing apparatus.

In FIG. 1 the apparatus for processing photographic film is designated by the general reference number 10. The apparatus 10 includes a spirally wound tube 12 mounted in a housing frame 14. The tube 12 includes a plurality of convolutions 16 having a top portion 18 and a bottom portion 20. The tube 12 also includes a first end portion 22 and a second end portion 24.

The elongated portion of the convolutions 16 of the tube 12 are positioned substantially vertical and parallel to each other. The tube 12 can be made of rigid or flexible materials such as various types of plastics, rubber, or synthetic materials. The tube construction should not be made of a material that will react chemically to the film treating agents used to process the film. The convolutions 16 contain various film treating agents that are continuously circulated through their portion of the tube 12. The tube connections, plumbing and circulating means for circulating the film treating agents are not shown in the drawings. The convolutions 16 can be made of various lengths depending on the time required for the film to be submerged in the agent or there can be more than one adjacent convolutions 16 containing the same agent.

The top portion 18 of the convolution 16 includes a vent 26. The vent 26 allows any air trapped in the tube to escape when the film treating agents are circulated through the convolutions 16. When adjacent convolutions 16 contain a different film treating agent there is normally a cross over convolution 28 which has a top portion 18 which is slightly higher than the adjacent convolution 16. The cross over convolution 28 will have one film treating agent in the upstream portion of the convolution and a different film treating agent in the downstream portion of the convolution. By making the cross over convolution 28 slightly higher than the adjacent convolutions, the different film agents are prevented from flowing over the top of the cross over convolution 28 and intermixing with a different agent.

While there are various types of film treating agents used to develop film, the following example illustrates what agents could be used in convolutions 16 of the tube 12. Starting at the first end portion 22, the first two convolutions 16*a* 16*b* and the upstream portion of the cross over convolution 16*c* contain a developing agent. The downstream portion of the cross over convolution 16*c*, convolutions 16*d*, 16*e*, 16*f* and the upstream portion of the cross over convolutions 16*g* contain a film bleach. The downstream portion of the cross over convolution 16*g* and the upstream portion of the cross over convolution 16*h* contain a film washing agent. The downstream portion of the cross over convolution 16*h*, convolutions 16*i*, 16*j*, 16*k* and the upstream portion of the cross over convolution 16*l* contain a fix agent. The downstream portion of the cross over convolution 16*l*, convolutions 16*m*, 16*n* and the upstream portion of the cross over convolution 16*o*, contain a wash. The downstream portion of the cross over convolutions 16*o*, convolutions 16*p*, 16*q*, 16*r*, 16*s* and the upstream portion of 16*t* are used for drying the film.

The apparatus 10 also includes a channeled infeed ramp 29 attached to and communicating with an infeed port 30 of the first end portion 22 for feeding magnetic carriers 32 having a film 34 shown in dotted lines clipped thereon into the tube 12.

The carriers 32 with film 34 are guided through the convolutions 16 by magnets 38 attached to an endless conveyor belt 38. The conveyor belt 38 is disposed adjacent to the outer surface of the inner circumference 40 of the convolutions 16 by drive pulleys 42 and idler pulleys 44. The pulleys 42 and 44 are held in position by pulley brackets 46 which are attached to the top portion 18 and bottom portion 20 of the convolutions 16. The drive pulleys 42 are driven by a drive motor 48 which is attached to the frame 14 by motor supports 50.

Attached to the end of the second end portion 24 of the tube 12 is a collection ramp 52 for receiving the carriers 32 and film 34 when they are discharged from a discharge port 54 of the second end portion 24 of the tube 12.

Figure 2:
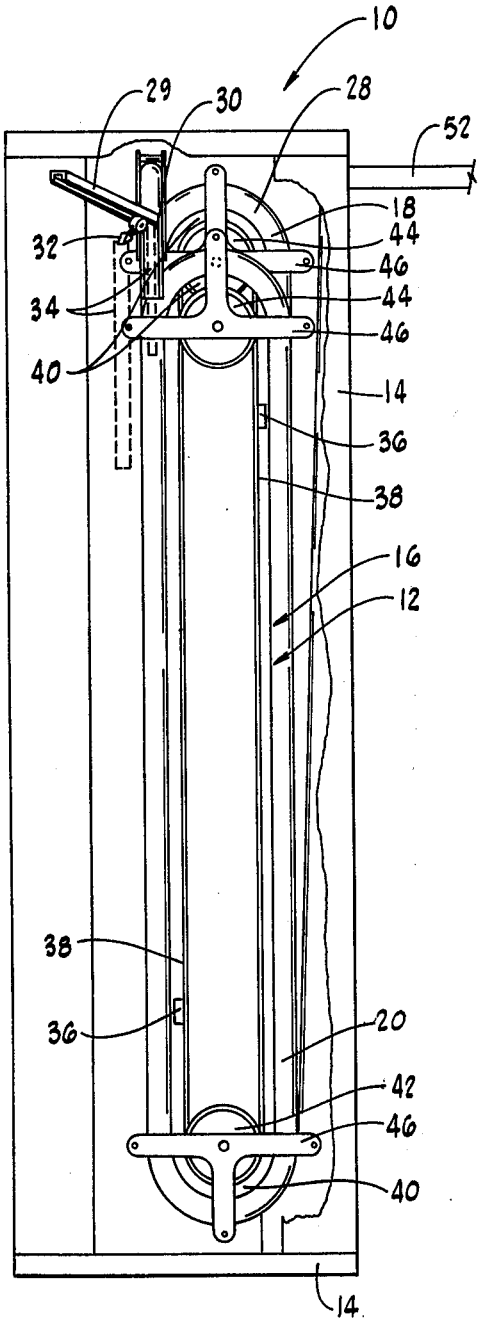
FIG. 2 is a front view of the apparatus.

FIG. 2 is a front view of the apparatus 10 showing the carrier 32 with film 34 mounted on the infeed ramp 29. A portion of the film 34 is seen extending out of the infeed port 30. The carrier 32 of this film 34 has already entered the infeed port 30 and started through the convolutions 16 of the tube 12. In this view the conveyor belt 38 with magnets 36 can be seen clearly disposed adjacent the inner circumference 40 of the convolutions 16. Also seen clearly is a front view of the drive pulley 42 and the idler pulleys 44. The top portion 18 of the cross over convolution 28 can be seen with idler pulley 44 positioned higher than the adjacent convolution 16 with idler pulley 44.

Figure 3:
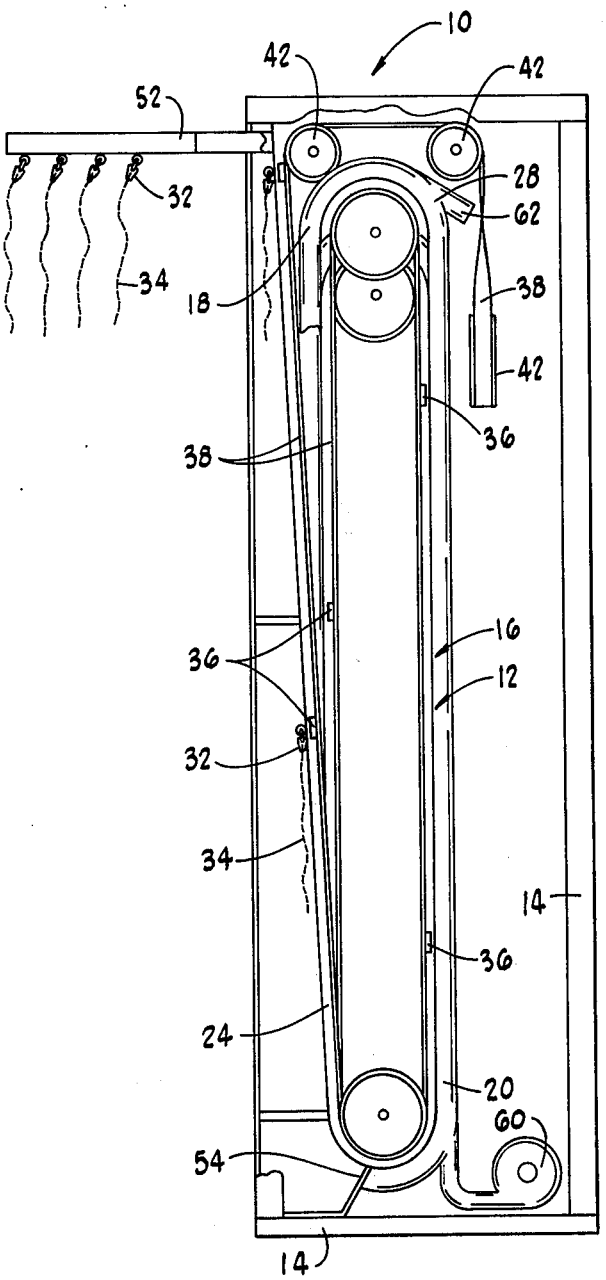
FIG. 3 is a rear view of the apparatus.

FIG. 3 is a rear view of the apparatus 10 showing the carriers 32 with film 34 mounted on the discharge ramp 52. A side view of the discharge port 54 of the tube 12 can be seen. From the discharge port 54 to the discharge ramp 52, a portion of the second end portion 24 of the tube is cut away exposing the carrier 32 and the film 34 which is shown with the magnet 36 attached to belt 38 disposed next to the remaining portion of the second end portion 24 and adjacent the carrier 32. The second end portion 24 is cut away to prevent the film 34 from becoming caught in the tube 12 when the carrier 32 is disengaged onto the discharge ramp 52.

A blower 60 is attached to the frame 14 and communicates with the second end portion 24 blowing hot air counter to the direction of the movement of the carrier 32 thereby drying the film 34 and keeping the film 34 in a trailing relationship to the carrier 32 as it is guided through the convolutions 16 used for drying the film and described under FIG. 1. Also seen in this view is a drain 62 in the top portion 18 of the cross over convolutions 28. The drain 62 is used to handle the over flow of the film treating agents when additional agents are added to the convolutions 16 to replenish the system. Also the drain helps prevent the agents from flowing over the top portion 18 and intermixing with a different film treating agent.

Figure 4:
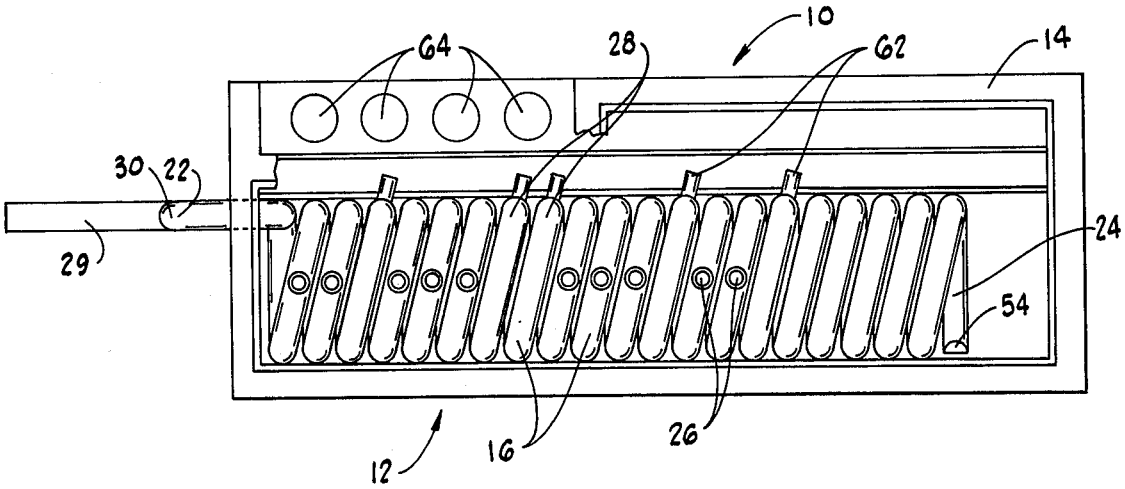
FIG. 4 is a top view of the apparatus.

FIG. 4 is a top view of the apparatus 10 showing tube 12 with the sequence of convolutions 16 starting at the first end portion 22 with infeed port 30 and ending at the second end portion 24 with discharge port 54. Seen in this view are annular shaped container holders 64 which are used to hold chemical filters for filtering the fluid film treating agents used in replenishing the agents contained in the convolutions 16.

Figure 5:
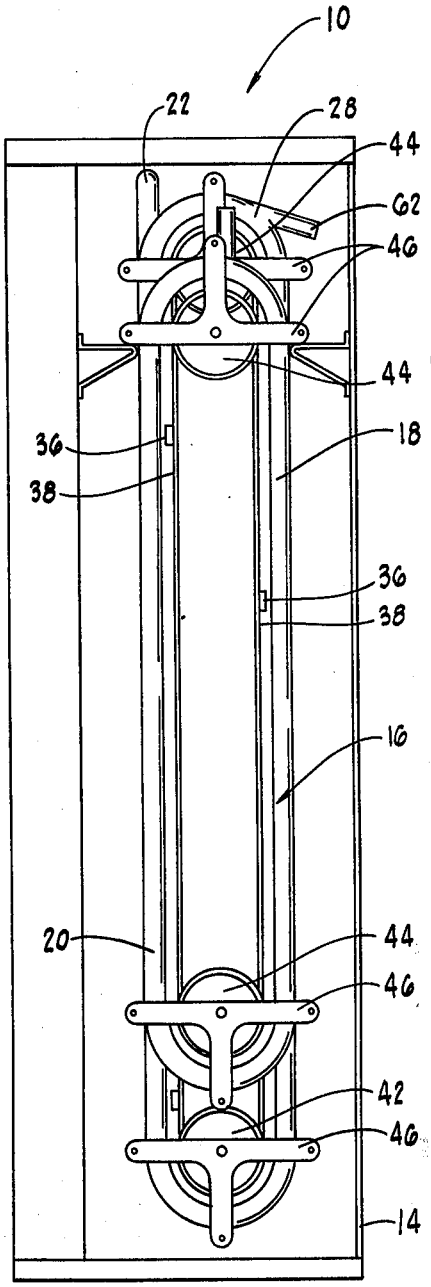
FIG. 5 is a front view of the apparatus showing an alternate embodiment.

FIG. 5 is an alternate embodiment of the apparatus 10 wherein, if it is desired to shorten the time required for the film 34 to be submerged in a particular agent, the convolution 16 contain that agent could be shorten. The convolution 16 can be seen with its over all length shorten compared to the adjacent convolution 16. The shorter convolution 16 in this case has idler pulleys 44 mounted to both its top portion 18 and bottom portion 20 and does not have a drive pulley 42.

Figure 6:
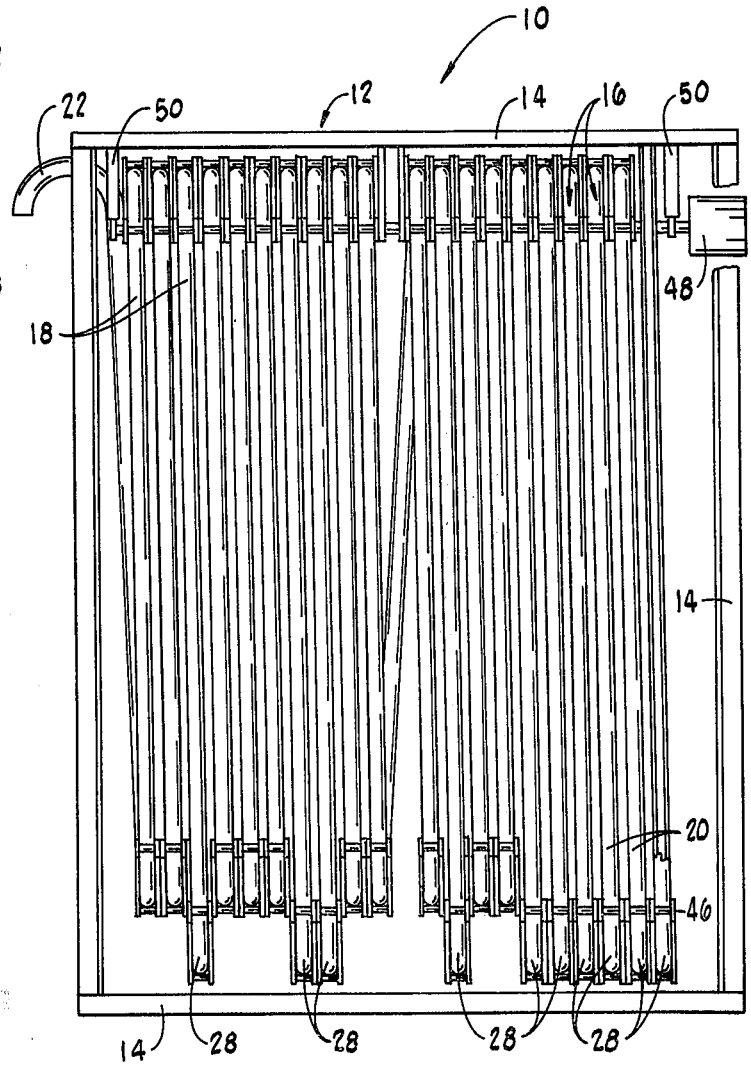
FIG. 6 is a side view of the apparatus showing an alternate embodiment.

FIG. 6 is an alternate embodiment of the apparatus 10 as shown in FIG. 1. In this figure the drive pulleys 42 are positioned inside the inner circumference of the convolution 16 at the top portion 18 rather than the bottom portion 20. The drive motor 48 is attached to the motor supports 50 which are suspended from the top of the frame 14.

Figure 7:
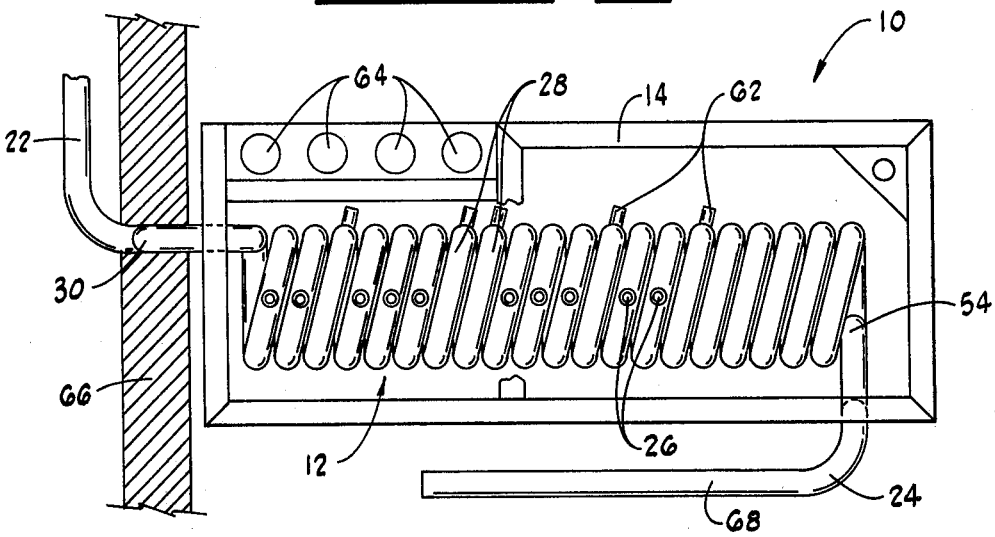
FIG. 7 is a top view of the apparatus showing an alternate embodiment.

FIG. 7 is a top view of the apparatus 10 and is similar to FIG. 4. In this view the tube 12 is shown with the first end portion 22 curved through a wall 66. On the left hand side of the wall 66 could be a dark room used for placing the film 34 on the carriers 32 and inserting them into the infeed port 40. On the right hand side of the wall could be a normally lighted room containing the apparatus 10. In this view the second end portion 24 of the tube 12 is shown curved and having an elongated portion 68 parallel to the length of the frame 14. This figure illustrates the flexibility of the tube 12 and positioning the first end portion 22 and the second end portion 24 of the tube 12 as desired.

Figure 8:
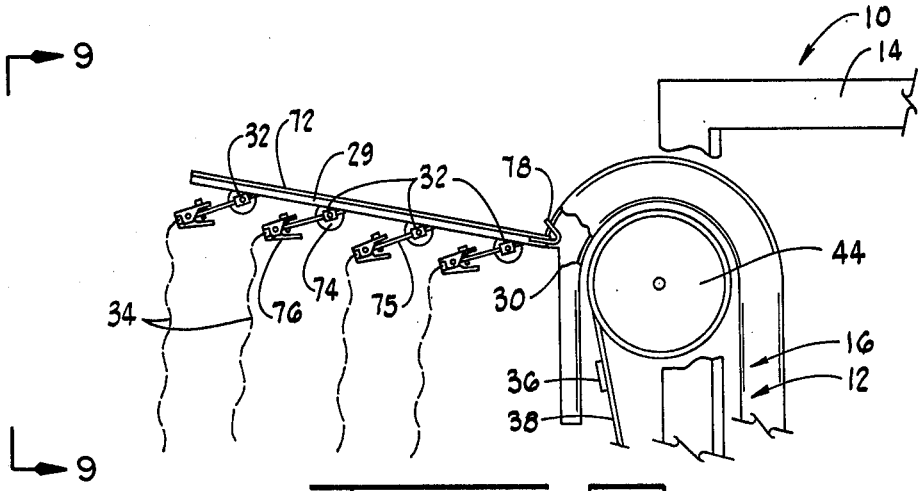
FIG. 8 is a side view of the infeed ramp.

FIG. 8 is a side view of the channeled infeed ramp 29 inclined downwardly toward the infeed port 30 of the tube 12. The ramp 29 includes an elongated magnetic bar 72 which magnetically attracts the carriers 32 and holds them positioned on the ramp 29. The carrier 32 includes a cylindrical roller 74 having a magnet contained therein, a film clip 76 and a film clip arm 75 attached to the roller 74.

The carriers 32 are held in spaced relationship to each other on the ramp by magnetic replusion of the like poles of the rollers 74. The carrier 32 is fed to a film guide 78 at the entrance of the infeed port 30 by gravity. When the magnet 36 on conveyor belt 38 is disposed adjacent the port 30 the carrier 32 is magnetically drawn into the tube 12. The film guide 78 acts to guide the carrier 32 into the tube 12 and unroll the film 34 as it passes thereby.

Figure 9:
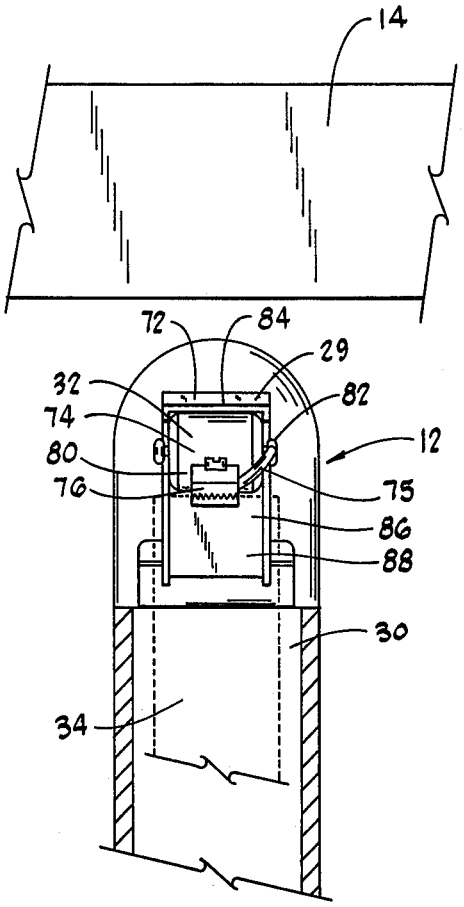
FIG. 9 is an end view taken along lines 9—9 shown in FIG. 8.

FIG. 9 is an end view of the infeed ramp 29 and taken along line 9—9 shown in FIG. 8. In this view the roller 74 of the carrier 32 can be seen with a cylindrically formed magnet 80 integrally formed as part of the roller 74. Attached to a roller shaft 82 of the roller 74 is the film clip arm 75 with film clip 76 attached to one end of the film 34 shown in dotted lines.

The ramp 29 is shown with the elongated bar magnet 72 mounted on a top portion 84 of the ramp 29. A bottom portion 86 of the ramp 29 includes a channel 88 for guiding the carriers 32 into the infeed port 30.

Figure 10:
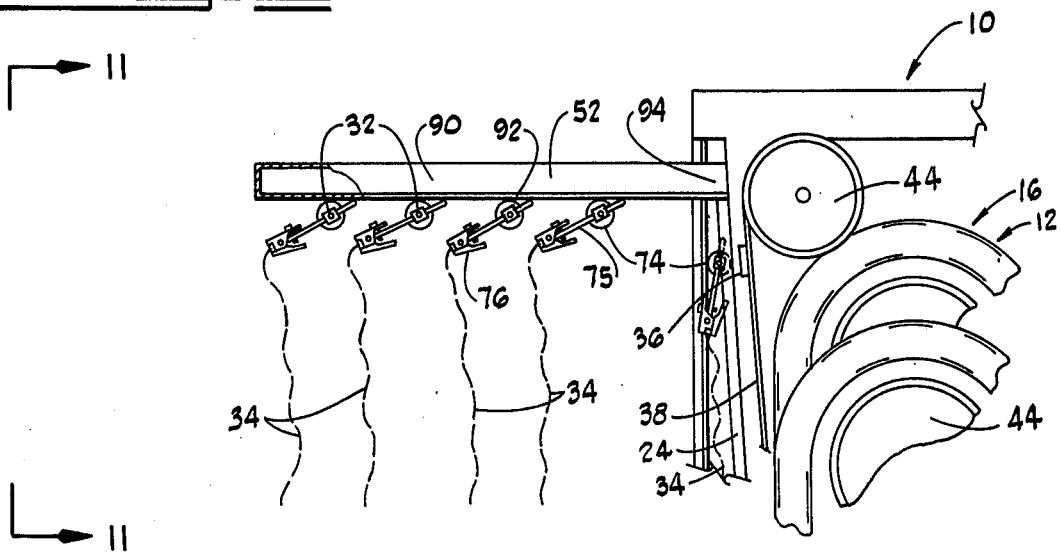
FIG. 10 is a side view of the discharge ramp.

FIG. 10 is a side view of the discharge ramp 52 with carriers 32 mounted thereon. The carriers 32 are held on the ramp 52 by the magnetic attraction of an elongated magnetic bar 90 which is mounted on the top of a metal plate 92. The discharge ramp 52 is similar to the infeed ramp 29 in that the carriers 32 are held in spaced relationship from each other by the magnetic repulsion of the like poles of each of the cylindrical magnets 80 mounted in the rollers 74.

The carriers 32 are discharged from the second end portion 24 of the tube 12 when the magnet 36 mounted on the conveyor belt 38 guides the carrier 32 out of the discharge port 54 and up the second end portion 24 until the carrier 32 abuts against an end portion 94 of discharge ramp 52. The carrier 32 is then rolled along the discharge ramp 54 before the film 34 is removed and the carrier 32 is reused.

Figure 11:
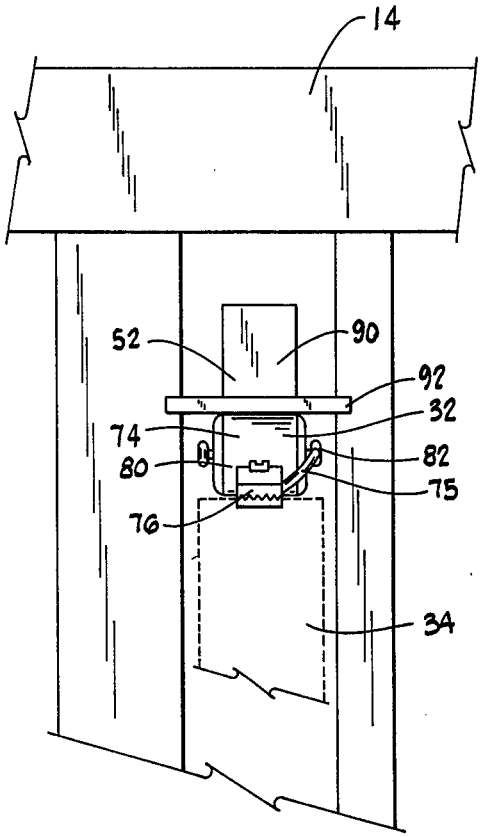
FIG. 11 is an end view taken along line 11—11 shown in FIG. 10.

FIG. 11 is an end view of the discharge ramp 52 taken along line 11—11 shown in FIG. 10. In this view the ramp 52 is seen with the elongated bar magnet 90 mounted on top of the metal plate 92. The carrier 32 is held by the magnetic attraction of the elongated bar 90 against the plate 92. The carrier 32 is similar to the carrier 32 as described under FIG. 9 wherein the carrier 32 includes the roller shaft 82 attached to the clip arm 75. The clip 76 is attached to the clip arm 75 and grips one end of the film 34 shown in dotted lines.

Figure 12:
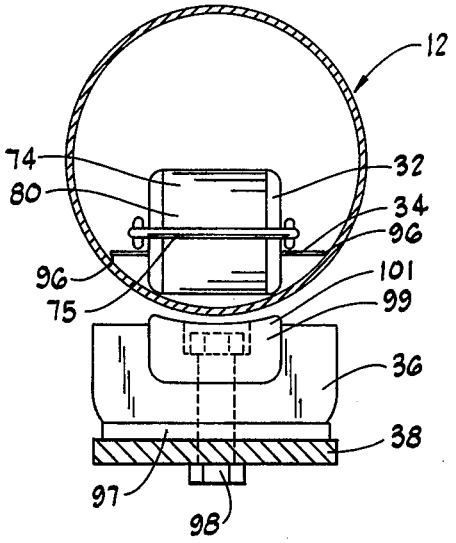
FIG. 12 is a sectional end view of the tube with the carrier and conveyor belt with magnet.

FIG. 12 is a sectional end view of the tube 12 with the carrier 32 and the film 34 in a trailing position. Note through the use of the tubes annular surface only the edges 96 of the film 34 contact the inner surface of the tube 12 thereby preventing the surface of the pictures in the film from contacting the inner surface of the tube 12 as it is guided through the convolutions 16. Disposed adjacent the carrier 32 and tube 12 is the magnet 36 having a U-shaped structure and attached to the conveyor belt 38 by a bolt 98. A magnet retainer 97 is attached to the belt 38 and disposed between the belt 38 and the magnet 36. The retainer 97 prevents the magnet 36 from turning on the belt 38. A plastic molded wear block 99 is positioned inside the U portion of the magnet 36. In operation the strong magnetic attraction between the magnet 36 and the carrier 32 will cause the magnet 36 to rub against the sides of the tube 12. The wear block 99 has an upper concaved shaped portion 101 which extends above the magnet 36 and prevents the magnet 36 from wearing against the tube.

Figure 13:
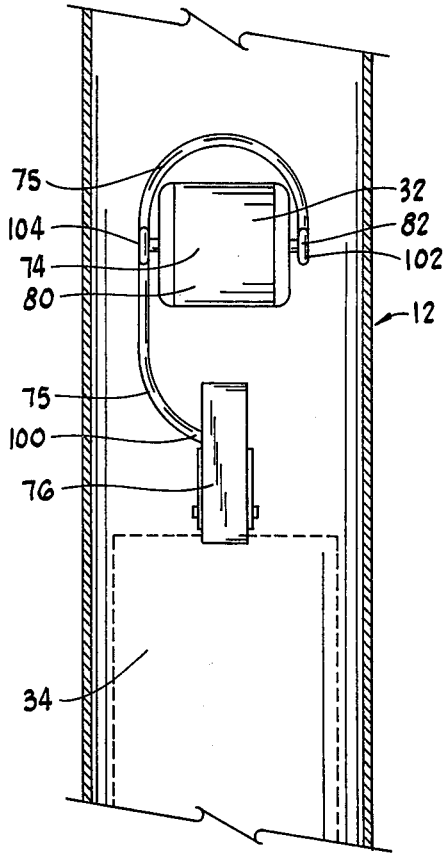
FIG. 13 is a sectional top view of the tube with the carrier and film.

FIG. 13 is a sectional top view of the tube 12 with the carrier 32 disposed therein. In this view the J-shaped clip arm 75 can be seen with one end portion 100 attached to the clip 76. The other end portion 102 and center portion 104 of the J-shaped arm 75 are rotatably attached to the shaft 82 of the roller 74.

Figure 14:
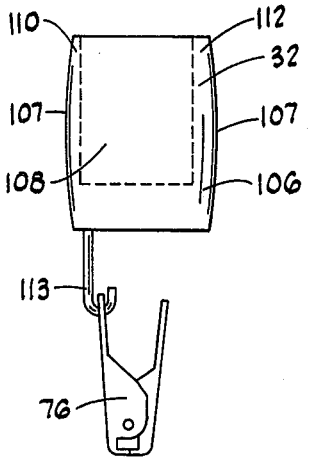
FIG. 14 is an alternate embodiment of the carrier.

In FIG. 14 an alternate embodiment of the carrier 32 is shown as a cylindrical carrier slide 106. The elongated sides 107 of the slide 106 are convex in shape thereby minimizing the surface area of the sides 107 which contact the inner surface of the tube 12 as the slide 106 is guided through the convolutions 16.

The slide is made of plastic or the like with a cylindrical shaped magnet 108 eccentrically positioned therein. As shown the magnet 108 is positioned closer to a bottom portion 110 of the slide than the opposite top portion 112. The slide 106 includes an integrally attached clip arm 113 with clip 76 attached thereto.

Figure 15:
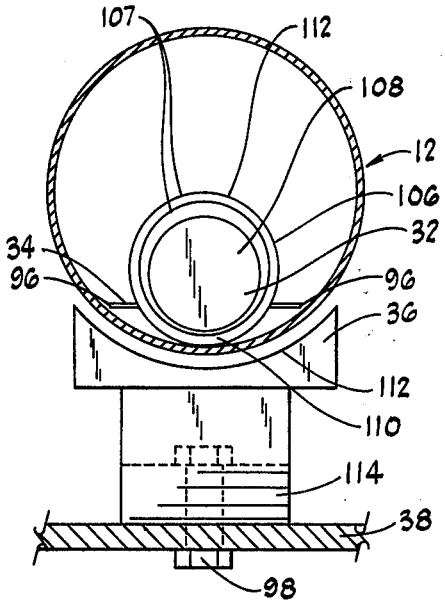
FIG. 15 is a sectional end view of the tube with an alternate embodiment of the carrier.

FIG. 15 is a sectional end view of the tube 12 with the carrier slide 106 shown in FIG. 14. The bottom portion 110 of the slide 106 is maintained in its present position due to the eccentrical positioning of the magnet 108 in the slide 106 thereby preventing the slide 106 from rolling laterally in the tube 12. An alternate embodiment of the magnet 36 is shown with a concave surface disposed adjacent the outer surface of the tube 12. In this view the magnet includes a spacer 114 which is bolted to the conveyor belt 38 by the bolt 98.

Figure 16:
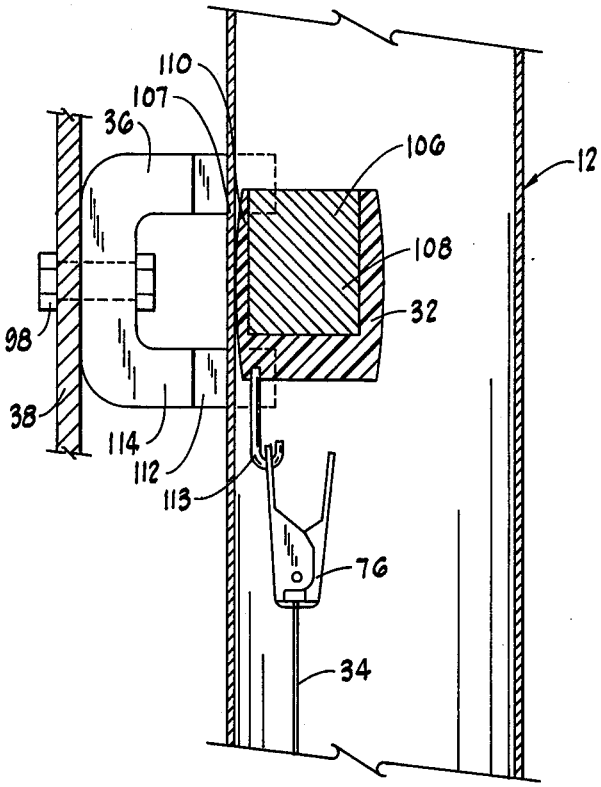
FIG. 16 is a sectional side view of the tube with an alternate embodiment of the carrier shown in FIG. 15.

FIG. 16 is a sectional side view of the tube 12 and slide 106 shown in FIG. 15. In this view the bottom portion 110 of the slide 106 can be seen positioned against the side of the tube 12. The magnet 108 of the slide 106 is magnetically attracted to the adjacently disposed magnet 36 with the concave surface 112. As mentioned in the discussion under FIG. 14 of the convex sides 107 of the slide 106 provide a minimum surface area in contact with the inner surface of the tube 12.

Figure 17:
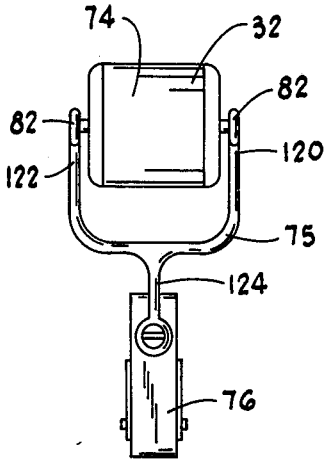
FIG. 17 is an alternate embodiment of the carrier clip arm.

FIG. 17 is an alternate embodiment of the carrier clip arm 75 having a Y-shaped structure with the arms of the Y 120 and 122 rotatably attached to the shaft 82 of the roller 74. A base 124 of the Y-shaped clip arm 75 is attached to the clip 76.

In operation the carrier 32 is placed on the infeed ramp 52 and fed into the infeed port 30 of the spirally wound tube 12. The carrier 32 with the trailing film 34 is guided through the convolutions 16 of the tube 12 by the magnetic attraction between the magnetic carrier 32 inside the tube 12 and an outside adjacently disposed magnet 36 mounted on an endless conveyor belt 38 which travels along the inner circumference of the convolutions 16.

As described under FIG. 1 the carrier 32 and film 34 are guided through the convolutions 16 which contain different fluid film treating agents used in developing the film 34. The conveyor belt 38 with the magnets 36 is driven at a constant speed by a drive motor 48. Therefore the carrier 32 is guided through the convolutions 16 at a constant speed and the time required for the film to be exposed to a particular fluid film treating agent can be determined and the required length of the convolutions 16 can be determined.

When the carrier 32 and film 34 have traversed through the convolutions 16 containing the various film treating agents, the film 34 is dryed by a blower 60 which communicates with the remaining convolutions 16 of the tube 12. When the film 34 is dried the carrier 32 with the film 34 exit the discharge port 54. The carrier 32 and film 34 are then received on a discharge ramp 52. The film 34 is then removed from the carrier 32 and the photographic film processing is completed.

Changes maybe made in the construction and arrangement of the parts or elements of the embodiment as disclosed herein without departing from the spirt or scope of the invention as defined in the following claims.

I claim:

1. A photographic film processing apparatus comprising:

a sequence of adjacent elongated chambers communicating with each other at their top and bottom portions and each adapted to contain a selected film treating fluid agent;

an infeed port communicating with a first terminal chamber of the sequence and a discharge port communicating with a second terminal chamber;

at least one carrier including a magnetic element carried thereon, said carrier dimensioned to traverse the inner surface of said chambers;

releasable grip means mounted on said carrier for releasably gripping one end of a length of film with the film maintained in a trailing relation to said carrier; and magnetic belt means disposed adjacent the outer surface of said chambers and magnetically responsive to the magnetic element of said carrier, said belt means operative for guiding said carrier through the elongated lengths of said chambers thereby subjecting the film to a succession of the film treating fluid agents in predetermined order.

2. The apparatus as described in claim 1 wherein, said belt means is driven at a constant speed and the length of said chambers is determined by the time required for the film to be exposed to the film treating fluid agent contained in said chambers.

3. The apparatus as described in claim 1 wherein, said adjacent elongated chambers are positioned substantially vertical and parallel to one another.

4. The apparatus as described in claim 1 wherein, said chambers contain more than one different film treating fluid agent.

5. The apparatus as described in claim 4 wherein, said adjacent chambers may contain the same film treating fluid agent.

6. The apparatus as described in claim 5 wherein, the film is continuously submerged in the film treating fluid agent as it is subjected to the succession of the film treating fluid agents in said chambers except where the adjacent chambers contain a different film treating fluid agent.

7. The apparatus as described in claim 6 wherein, the second terminal chamber includes film drying means attached thereto for circulating a film drying gas therein.

8. A photographic film processing apparatus comprising:

a spirally wound tube, each convolution of said tube having a top and bottom portion, the convolutions adapted to contain a sequence of selected film treating fluid agents therein;

an infeed port communicating with a first end portion of said tube and a discharge port communicating with a second end portion of said tube;

at least one carrier including a magnetic element carried thereon, said carrier dimensioned to traverse the inner surface of said tube;

releasable grip means mounted on said carrier for releasably gripping one end of a length of film with the film maintained in trailing relation to said carrier; and magnetic belt means disposed adjacently the outer surface of said tube and magnetically responsive to the magnetic element of said carrier, said belt means operative for guiding said carrier through the spirally wound tube thereby subjecting the film to the sequence of film treating fluid agents in predetermined order.

9. The apparatus as described in claim 8 wherein, said carrier is a carrier roller, said roller adapted to roll on the inner surface of said tube.

10. The apparatus as described in claim 8 wherein, said carrier is a slide having a sliding surface adapted to slide on the inner surface of said tube.

11. The apparatus as described in claim 8 wherein, said releasable grip means is a clip mounted on the rearward end of said carrier for releasably engaging the end of the film.

12. The apparatus as described in claim 8 wherein, said belt means is driven at a constant speed and the length of the convolutions is determined by the time required for the film to be exposed to the film treating fluid agent contained in the convolutions.

13. The apparatus as described in claim 8 wherein, the elongated portions of the convolutions of said tube are substantially vertical, said convolutions being positioned adjacent and parallel to one another.

14. The apparatus as described in claim 13 wherein, the convolutions contain more than one different film treating fluid agent.

15. The apparatus as described in claim 14 wherein, the adjacent convolutions may contain the same selected film treating fluid agents.

16. The apparatus as described in claim 15 wherein the film is continuously submerged in the film treating fluid agent as it is subjected to the succession of the film treating fluid agents in the convolution except where the adjacent convolutions contain a different film treating fluid agent.

17. The apparatus as described in claim 16 wherein, the second end portion of said tube includes a film drying means attached thereto for circulating a film drying gas therein.

18. The apparatus as described in claim 17 wherein, the top portion of the convolutions includes vent means.

19. The apparatus as described in claim 18 wherein, the top portion of a convolution positioned between convolutions containing different film treating fluid agents is positioned vertically higher than the top portion of the convolution on either side thereby preventing the film treating fluid agent from over flowing and intermixing with a different film treating fluid agent in the adjacent convolution.

20. The apparatus as described in claim 19 wherein, the convolutions positioned vertically higher include a drain in the top portion thereof.

21. The apparatus as described in claim 8 wherein, said magnetic belt means is disposed adjacent the inner circumference of the outer surface of said tube.

22. The apparatus as described in claim 21 wherein, said magnetic belt means includes an endless conveyor belt, said belt having individual magnets attached thereon in spaced relationship to each other, each magnet responsive to the magnetic element of said carrier.

23. The apparatus as described in claim 22 wherein, said conveyor belt is driven by drive pulleys rotatably attached to a drive motor.

24. The apparatus as described in claim 23 wherein, said magnetic belt means further includes idler pulleys, said drive pulleys and said idler pulleys are attached to the top portion and the bottom portion of the convolutions of said tube by pulley brackets.

25. The apparatus as described in claim 8 further including, a plurality of carriers and an infeed ramp attached to the first end portion, said infeed ramp dimensioned to support said carriers in aligned relationship to each other and feeding said carriers into the infeed port.

26. The apparatus as described in claim 8 further including, a plurality of carriers and a discharge ramp positioned at the end of the second end portion and attached thereto, said discharge ramp receiving said carriers from the discharge port and dimensioned to support said carriers in aligned relationship thereon.

27. A method of processing photographic film, the steps comprising:

attaching one end of a film to be photographically processed to a carrier, the carrier having a magnetic element carried thereon;

feeding the carrier with the film maintained in a trailing relationship into an infeed port communicating with a first terminal chamber of a sequence of chambers communicating with each other at their top and bottom portions, each chamber containing a selected film treating fluid agent;

guiding the carrier through the sequence of chambers containing the selected film treating fluid agent by magnetic belt means disposed adjacent the chambers and magnetically responsive to the magnetic element of the carrier; and discharging the carrier through a discharge port communicating with a second terminal chamber at the end of the sequence of the chambers thereby completing the photographic processing of the film.

28. The method as described in claim 27 further including, the step of drying the film in the second terminal chamber by a film drying gas prior to the step of discharging the carrier through the discharge port.

* * * * *